US005112034A

United States Patent [19]

Uto et al.

[11] Patent Number: 5,112,034

[45] Date of Patent: May 12, 1992

[54] SHEET HANDLING APPARATUS

[75] Inventors: Nobutaka Uto, Yokohama; Takeshi Honjo, Kawasaki, both of Japan

[73] Assignee: Canon Kabushiki Kaisha, Tokyo, Japan

[21] Appl. No.: 724,472

[22] Filed: Jun. 28, 1991

Related U.S. Application Data

[63] Continuation of Ser. No. 626,371, Dec. 5, 1990, abandoned, which is a continuation of Ser. No. 535,984, Jun. 8, 1990, abandoned, which is a continuation of Ser. No. 436,973, Nov. 16, 1989, abandoned, which is a continuation of Ser. No. 209,959, Jun. 22, 1988, abandoned.

[30] Foreign Application Priority Data

Nov. 10, 1987 [JP] Japan ..... 62-284565

[51] Int. Cl.[5] ..... B42B 1/04

[52] U.S. Cl. ..... 270/53; 270/52; 270/58

[58] Field of Search ..... 270/37, 52, 53, 58; 271/279, 287, 280, 290, 302; 355/308, 321, 322, 323, 324

[56] References Cited

U.S. PATENT DOCUMENTS 4,508,447 4/1985 Doery .
4,558,942 12/1985 Chiama ..... 270/53
4,561,765 12/1985 Masuda .
4,566,782 1/1986 Britt ..... 270/53
4,586,640 5/1986 Smith ..... 270/53
4,627,709 12/1986 Kitajima et al. .
4,696,563 9/1987 Shibusawa .
4,717,134 1/1988 Iida et al. .
4,782,363 11/1988 Britt ..... 270/53

FOREIGN PATENT DOCUMENTS

2818738A1 11/1978 Fed. Rep. of Germany .
60-204570 10/1985 Japan .
62-022145 5/1987 Japan .

*Primary Examiner*—Edward K. Look
*Assistant Examiner*—Therese M. Newholm
*Attorney, Agent, or Firm*—Fitzpatrick, Cella, Harper & Scinto

[57] ABSTRACT

The present invention relates to a sheet handling apparatus comprising a sheet processing means, a first and a sheet transport path and a second sheet transport path separated therefrom, transport direction switch means and control means. The first and second sheet transport paths transport the sheets to the processing means, the second sheet transport path, the transport direction of the sheet is switched by the transport direction switch means which is controlled by the controlling means according to the function of the processing means.

58 Claims, 12 Drawing Sheets

SHEET HANDLING APPARATUS

This application is a continuation of application Ser. No. 626,371 filed Dec. 5, 1990, now abandoned, which was a continuation application of Ser. No. 535,984, filed Jun. 8, 1990, now abandoned, which was a continuation application of Ser. No. 436,973, filed Nov. 16, 1989, now abandoned, which was a continuation application of Ser. No. 209,959, filed Jun. 22, 1988, now abandoned.

BACKGROUND OF THE INVENTION

1. Field of the Invention

The present invention relates to a sheet handling apparatus for use in combination with an image forming apparatus such as copying machine, printer, laser beam printer or the like, and more particularly to a sheet handling apparatus including a sheet post-processing device to be connected to said image forming apparatus for stacking the sheets discharged from said apparatus and collating, stapling or punching said sheets, or an intermediate tray provided in the image forming apparatus for temporarily stacking sheets, bearing image on a face, for image formation on the other face or multiple image formation on the same face.

2. Related Background Art

There is already known, as disclosed in the U.S. Pat. No. 4,717,134, a sheet processing apparatus to be connected to a copying machine and capable of transporting the sheets discharged from the copying machine onto a processing tray, then registing the ends of the sheets stacked on said tray and stapling said sheet, and transporting the stapled bundle of sheets from the processing tray onto a storage tray. Also decurling and registration of sheets are conducted in an intermediate tray in the copying machine.

In such sheet processing apparatus, during the processing of sheets on the processing tray, the next sheet cannot be sent to said tray and this fact gives rise to a waste in time, leading to the deteriorated productivity in the entire system.

For resolving this drawback, the Japanese Laid-open Patent No. 60-204570 proposed a structure of temporarily storing the sheets, discharged from the copying machine, in a storage tray, and feeding the tray stored in the storage tray in response to the command from the sheet post-processing apparatus. However, such structure becomes inevitably large and expensive as there is required means for separating and feeding the sheets, stacked in the storage tray, in the order of storage namely one by one from the bottom to the sheet post-processing apparatus.

Also in a finishing apparatus disclosed in the Japanese Patent Publication No. 62-22145, there is employed a structure of stopping a pair of transport rollers provided in a transport path for guiding the sheets to a stapling tray, stopping the first sheet at the nip of said rollers, then stopping also the second sheet at said nip, stapling and discharging the sheets already stacked on the stapling tray while the succeeding sheets are stopped as explained before, and sending two sheets together by said rollers to the stapling tray. In the above-explained structure, in order to superpose the sheets in the order of supply from the copying machine, the sheet-stopping portion of the transport path is curved in U-shape and the first sheet is maintained in close contact with the outside guide member of the curved portion thereby preventing the succeeding sheet from entering between the guide member and the first sheet.

However, such U-curved transport path requires a large space, eventually increasing the dimension of the apparatus. Also for achieving close contact of the first sheet with the output guide member of curved portion the sheet is required to have certain rigidity so that the usable sheets are limited. Besides the rigidity of sheet is variable depending on the temperature and humidity, and the function of the structure is not stable as the sheet may not be contacted with the guide member even for a same sheet. Also the mutual friction of sheets may generate static electricity, eventually disturbing the aligning operation on the stapling tray. Furthermore, since the sheet has to pass through the curved path even in the normal copying without stapling, the efficiency of transportation is low and the probability of sheet jamming is high.

SUMMARY OF THE INVENTION

It is an object of the present invention to prevent the above-mentioned drawbacks and to provide a sheet post-processing apparatus having a high productivity with a simple structure. This object can be achieved by forming a second sheet transport path in the vicinity of sheet outlet, guiding the next sheet into said second path during the processing of the preceding sheet in the post-processing apparatus, and advancing said next sheet after appropriate stopping in said second path, thereby avoiding the inconvenience of suspending the copying operation for the succeeding sheets during the processing preceding sheets, thus eliminating the waste in time and improving the productivity of the entire system.

DETAILED DESCRIPTION OF THE PREFERRED EMBODIMENTS

Figure 1:
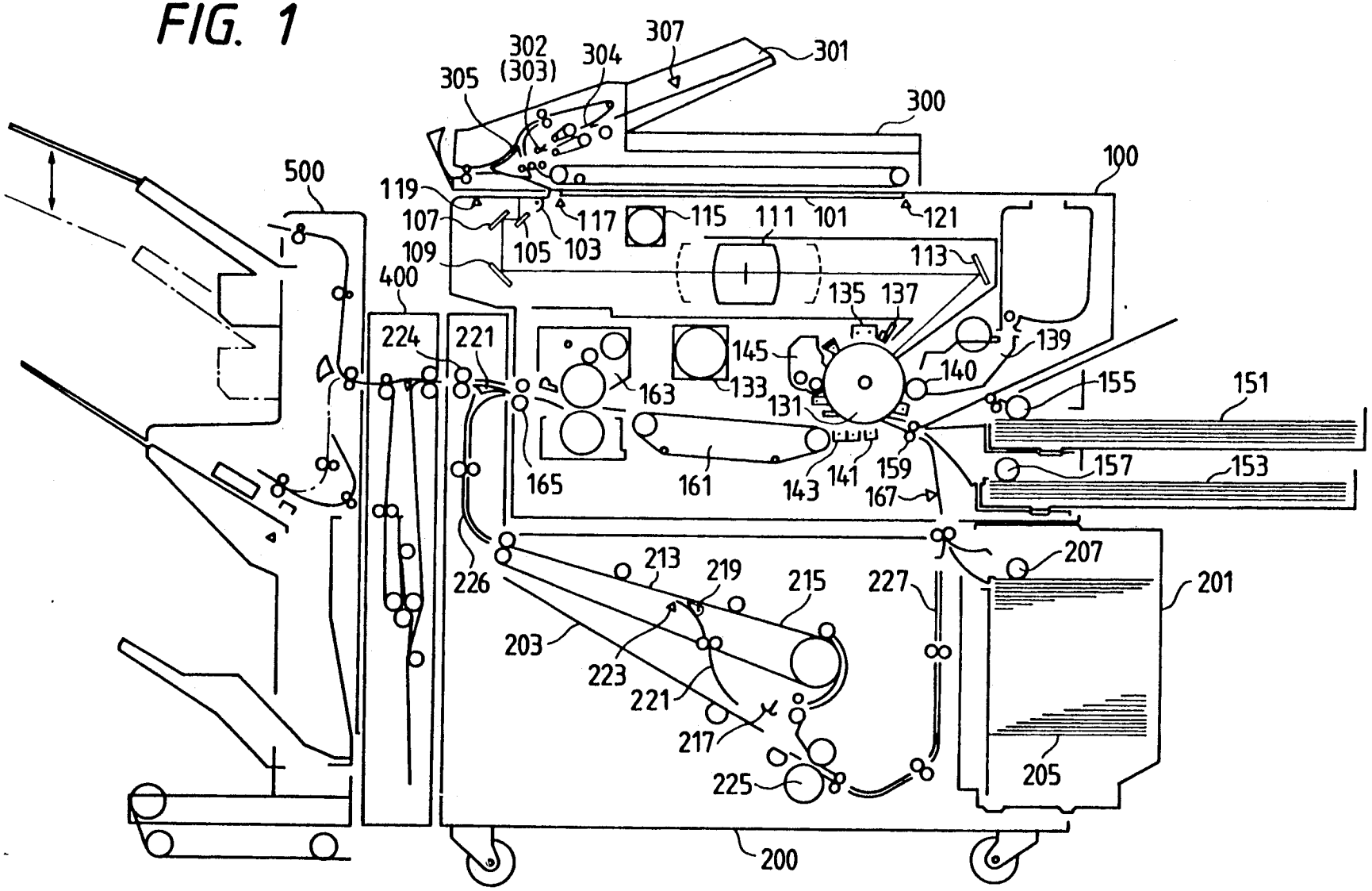
FIGS. 1 and 2 are lateral cross-sectional views of a system and a sheet post-processing apparatus embodying the present invention.
Figure 2:
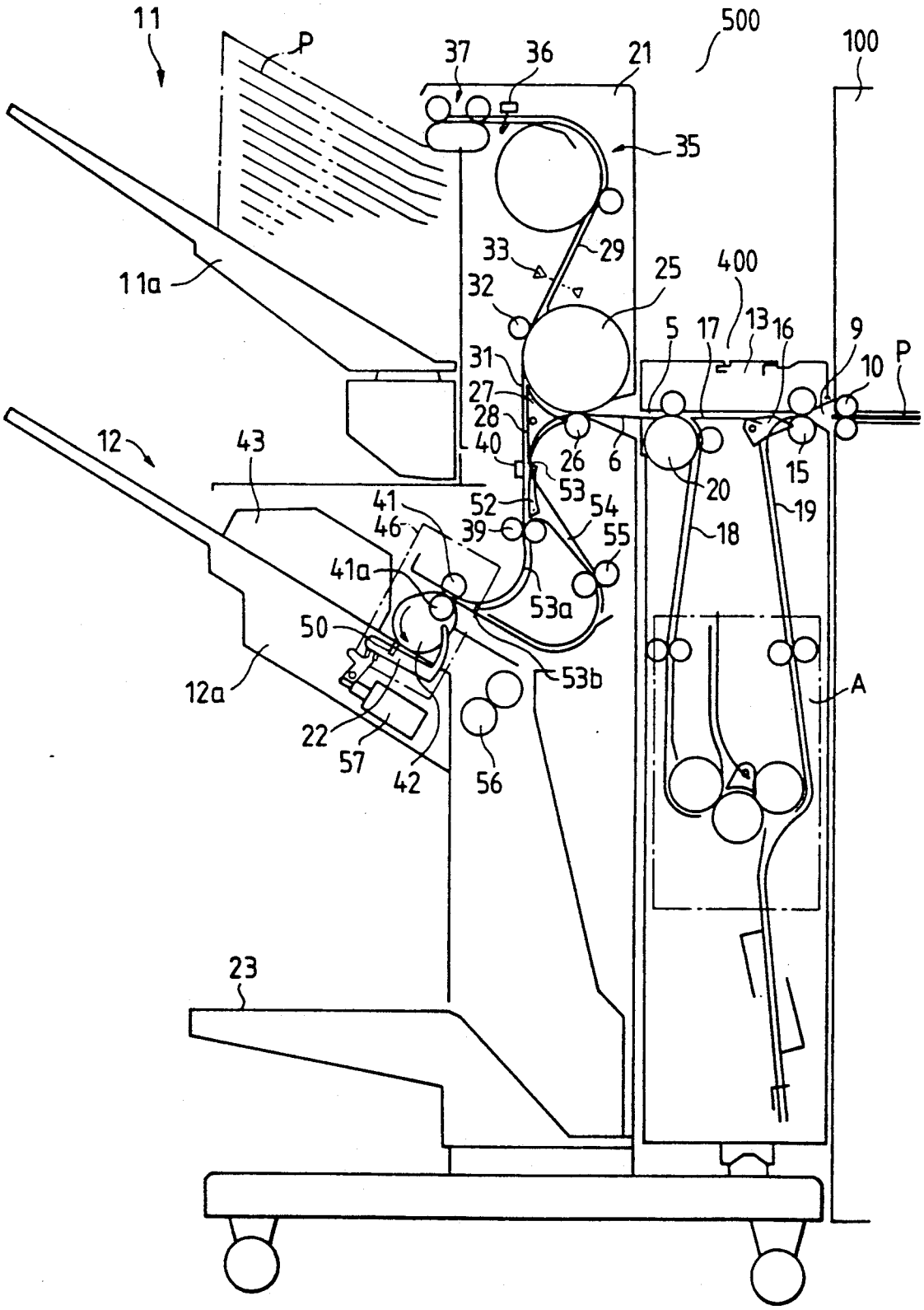
Figure 3:
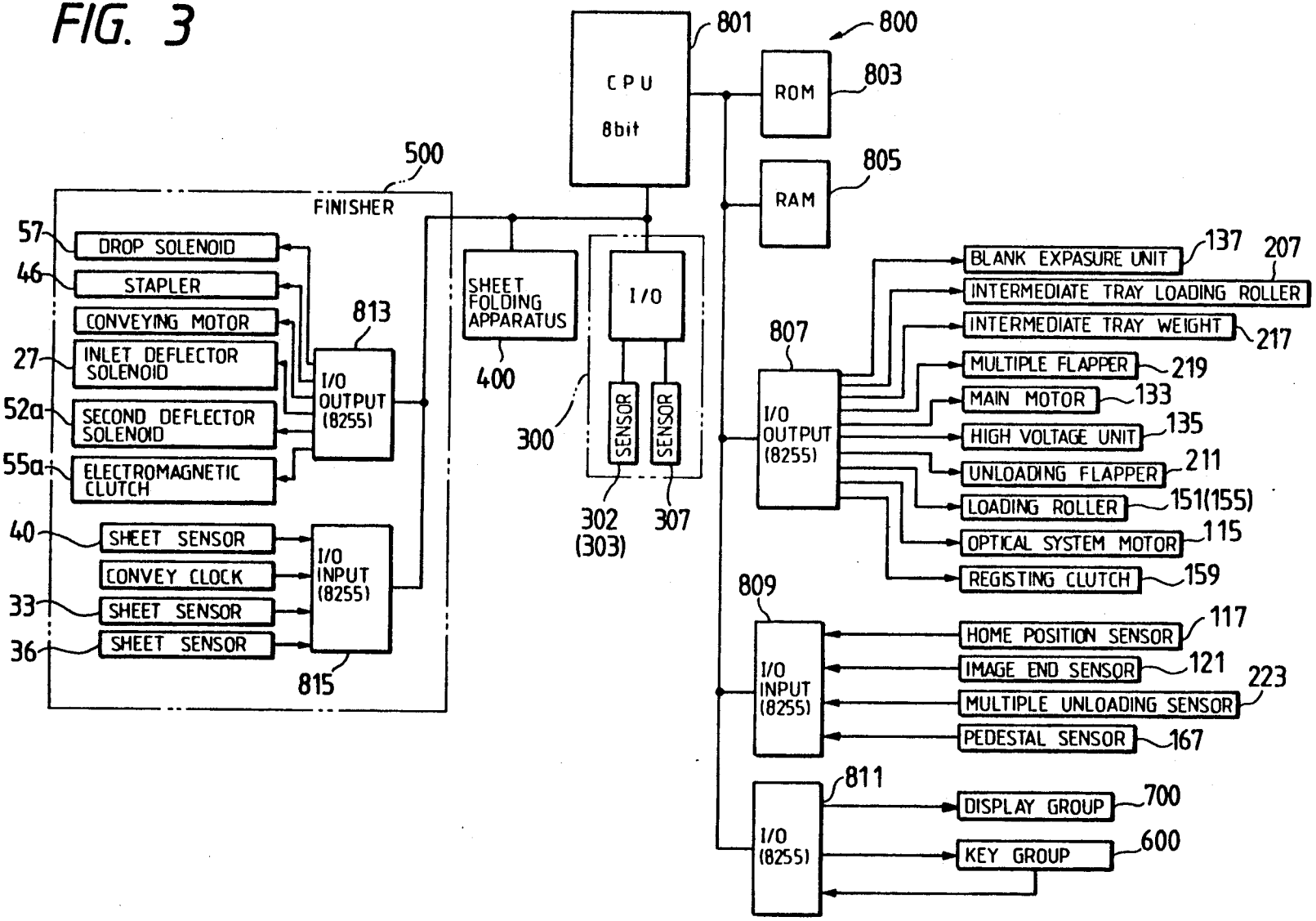
FIG. 3 is a block diagram of a control circuit.

FIGS. 1 and 2 illustrate the internal structure of an embodiment of the sheet post-processing apparatus and the image recording apparatus of the present invention, and FIG. 3 shows the circuit structure of a control unit thereof In FIG. 1, there are shown a main unit 100 constituting an image forming unit capable of image reading and image recording; a pedestal 200 for two-side processing function for inverting the recording sheet in two-side recording and multiple recording function for multiple recordings on a same recording sheet; a recycling document feeder (RDF) for automatic feeding of original documents; and post-processing units (finishers) 400 for folding function for folding the sheet at a predetermined position, and 500 for sorting and stapling functions.

These units 200-500 can be used in arbitrary combination with the main unit 100.

A. Main unit (100)

In the main unit 100, there are provided an original support glass 101 for supporting an original document; an illuminating (exposure) lamp 103 for illuminating the original document; scanning mirrors 105, 107 and 109 for deflecting the path of light reflected by the original document; a lens 111 capable of focusing and image size variation; a fourth scanning mirror 113 for deflecting the light path; an optical system motor 115 for driving the optical system, and sensors 117, 119 and 121. The sensors 117 and 121 respectively control the start and end of the exposure operation.

There are further shown a photosensitive drum 131; a main motor 133 for driving the photosensitive drum; a high-voltage unit 135; a blank exposure unit 137; a developing unit 139; a transfer charger 141; a separating charger 143; and a cleaning unit 145.

Further provided are an upper cassette 151; a lower cassette 153; sheet feeding rollers 155 and 157; registration rollers 159; a conveyor belt 161 for transporting the sheet, after image recording, to the fixing unit; a fixing unit 163 for fixing the image of the transported sheet with heat and pressure; and a sheet (pedestal) sensor 167 used in two-side recording.

The photosensitive drum 131 is provided, at the periphery thereof, with a seamless photosensitive member composed of a photoconductive layer and a conductive layer, is rotatably supported and rotated in a direction indicated by an arrow by the main motor 133, in response to the depression of a copy start key to be explained later. After a preliminary step for the drum 131, consisting of rotation control and potential control, the original document placed on the original support glass 101 is illuminated by the illuminating lamp 103 constructed integrally with the first scanning mirror 105, and the light reflected from the original document is guided by the first scanning mirror 105, second scanning mirror 107, third scanning mirror 109, lens 111 and fourth scanning mirror 113, and is focused on the photosensitive drum 131.

The drum 131 is corona charged by the high voltage unit 135, and is subjected to slit exposure of the image of the original document illuminated by the lamp 103, whereby an electrostatic latent image is formed on the drum 131 by the known NP-process.

The electrostatic latent image on the photo-sensitive drum 131 is developed by a developing roller 140 of the developing unit 139 as a visible toner image, which is then transferred by the transfer charger 141 onto a sheet as will be explained later.

The sheet stored in the upper cassette 151 or the lower cassette 153 is fed into the main unit by the sheet feeding roller 155 or 157, and is advanced toward the photosensitive drum 131 with an exact timing with the registration rollers 159 in such a manner that the front end of the latent image coincides with that of the sheet. Subsequently, the toner image on the drum 131 is transferred onto the sheet when it passes between the transfer charger 141 and the drum 131. After said image transfer, the sheet is separated from the drum 131 by the separating charger 143, transported to the fixing unit 163 by the conveyor belt 161, subjected to image fixation by heat and pressure therein, and finally discharged from the main unit 100 by discharge rollers 165.

The drum 131 after the image transfer continues to rotate, and the surface thereof is cleaned by a cleaning unit 145 composed of a cleaning roller and an elastic blade.

B. Pedestal (200)

The pedestal 200 is constructed separably from the main unit 100, and is provided with a deck 201 capable of holding 2000 sheets, and an intermediate tray 203 for two-side or both-side copying. A lifter 205 for said deck 201 lifts the deck according to the amount of sheets in such a manner that the sheet feeding roller 207 is always in contact with the sheets.

There are also provided a sheet discharge flapper 211 for selecting a sheet path for two-side recording or multiple recording or a sheet discharge path; transport paths 213 and 215 consisting of a conveyor belt; and a sheet pressing weight 217 for the intermediate tray. The sheet transported through the flapper 211 and paths 213 and 215 is stored, after inversion or upside down, in the intermediate tray 203 for two-side copying. A multiple-recording flapper 219, for selecting the path for two-side recording or that for multiple recording, is positioned between the transport paths 213 and 215, and guides the sheet to a multiple recording sheet path 221 when positioned upwards. A multiple-recording sheet discharge sensor 223 detects the trailing end of the sheet passing through the multiple-recording flapper 219. There are also provided sheet feeding rollers 225 for feeding the sheet toward the drum 131 through a path 227, and discharge rollers 224 for discharging the sheet from the unit.

In two-side recording or multiple recording, the sheet discharge flapper 211 of the main unit 100 is moved upwards to store the sheet after copying in the intermediate tray 203 through the paths 213 and 215 of the pedestal 200. The multiple recording flapper 219 is positioned downwards or upwards respectively in the two-side recording or in the multiple recording. Said intermediate tray can hold for example 99 sheets at maximum. The sheets stored in the intermediate tray 203 are maintained in place by the weight 217.

In the succeeding recording on bottom face or in multiple recording, the sheets stored in the intermediate tray 203 are fed one by one from the bottom, by the function of the feeding roller 225 and the weight 217, through the path 227 to the registration rollers 159 of the main unit 100.

C. Recycling document feeder (RDF) (300)

In the recycling document feeder 300, a tray 301 is provided for setting the original documents. Original size sensors 302 and 303 are provided with a predetermined distance along a direction perpendicular to the plane of drawing. The width size of the original document can be identified according to whether the original document is detected by two sensors, or only by the sensor 303, which is positioned at the rear when seen from the plane of drawing. A more precise size detection is possible by increasing the number of such sensors. Also the length of the original document can be identified from the duration of detection of the original document by the sensor 303 (or 302).

In said recycling document feeder 300, the original document sent from the stacker tray 301 to an exposure position through a sheet path 304 can be returned to the stacker tray 301 through a sheet path 305. A sensor 307 is provided for detecting a cycle of the original documents.

D. Sheet post-processing apparatus

In the following there will be explained the details of the sheet post-processing apparatus, with reference to FIG. 2.

As shown in FIG. 2, said apparatus is composed of a folder unit 400 and a finisher unit 500, which are mutually connected in such a manner that a sheet exit 5 of the folder unit 400 coincides with a sheet entrance 6 of the finisher unit 500. Also the sheet post-processing apparatus is connected to the main unit 100 in such a manner that a sheet exit 10 thereof coincides with a sheet entrance 9 of the folder unit 400, or connected to the main unit 100 through the flapper 211 and discharge rollers 224 of the pedestal 200.

In said post-processing apparatus, the sheets P discharged from the main unit 100 are folded in the folder unit 400, and stacked in a stacker unit 11 or a stapling unit 12 of the finisher 500 and then stapled.

In the folder unit 400, a pair of inlet rollers 15 are positioned facing the sheet entrance at the right-hand side of an upper portion 13 of the folder unit. Behind said rollers 15 there is provided an entrance deflector 16 which is movable in two positions for guiding the sheets from the entrance 9 toward a through path 17 or a folding path 19. At the downstream end of the through path 17 there are provided paired discharge rollers 20, behind which provided is a sheet exit 5 at the same level as the sheet entrance 9 At the downstream end of the sheet folding path 19 there is provided folding means A for two-folding or Z-folding the sheet P, and said folding means A is connected through a discharge path 18 to the through path 17.

In the finisher unit 500, a stacker unit 11 having a stacker vertically movable for example with a motor is provided at the upper left portion of a main body 21. Below said stacker unit 11 there is provided a processing tray **12*a* of a stapling unit 12, and a rotatable stopper 22 supporting an end of the sheets P is provided at the lower end of said tray 12*a*. Below said stapling unit 12 there is provided a storage tray 23, and, by the rotation of said stopper 22, the sheets P on the processing tray 12*a* drops through bundle transport rollers 56 onto and are stored on the tray 23**.

In the upper front portion of the main body 21 of the finisher unit 500 there is provided a sheet entrance 6 at the same level as the sheet exit 10 of the copying unit 100. At said sheet entrance 6 there are provided paired guide rollers 25 and 26 behind which provided is an entrance deflector 27 movable in two positions for guiding the sheet P from the sheet entrance 6 either to a stacker path 29 or a stapling path 53.

The rear face of said entrance deflector 27 constitutes an inverting path 28. In the stacker path 29 there is provided a polyster strip 31 for checking reverse movement in the vicinity of said entrance deflector 27, and, at the downstream side of said polyester strip 31 there is provided a transport roller 32 maintained in contact with said guide roller 25. At the downstream side of said roller 32, there are provided, in succession, an inversion sensor consisting of a light-emitting element and a light-receiving element, and a transport roller member 35. At the downstream side of said roller member 35 there are provided, in succession, a sensor 36 for detecting the sheet P and stacker discharge rollers 37.

In the stapler path 53 there is provided a sensor 40 for detecting the passing of the sheet P, and said path is divided, at the downstream side, into a first stapler path **53*a* and a second stapler path 54 parallel thereto. The sheet advancement into said paths is switched by a second deflector 52driven by a second deflector solenoid 52*a* (see FIG. 3). The first stapling path 53*a* is provided with paired transport rollers 39, while the second stapling path 54 is provided with paired transport rollers 55**.

The transport rollers 55 are connected, through a magnetic clutch (not shown), to a motor (not shown) for driving the rollers of the finisher main body 21, and can be independently turned on or off by said clutch even when the motor is continuously rotated. The transport motor (not shown) is provided with an encoder for generating pulses corresponding to the rotation of said motor, and said pulses are supplied to a control unit for controlling the sheet transportation.

The first stapling path **53*a* and the second stapling path 54 join together at the downstream side, and, behind the joining part 53*b* there are provided paired stapler discharge rollers 41. The lower one 41*a* of said paired discharge rollers 41 supports a belt 42 of which lower end is in contact with the processing tray 12*a*. Said belt 42 rotates together with the lower roller 41*a* to regist the sheets P, discharged onto the processing tray 12*a*, in longitudinal direction against the stopper 22. The registration of the sheets P in the lateral direction is achieved by pushing the sheets P against a positioning plate 43 by means of a pushing plate. (not shown) A stapler 46 is provided above the lower end of the processing tray 12*a***, for stapling the sheets P on said tray.

The sheet P discharged from the sheet exit 10 of the copying unit 100 is guided to the entrance deflector 16 through the sheet entrance 9 of the folder unit 400, by the rotation of the rollers 15, and is guided to the through path 17 by said deflector 16 when a passing mode is instructed to the folder unit 400 by keys 600 of the copying unit 100 (see FIG. 3). Thus the sheet is ejected through the sheet exit through said path 17 and by the discharge rollers 20. On the other hand, when a folding mode is instructed to the folder unit 400, the sheet P is guided to the folding path 19 by the entrance deflector 16, and is transported to the folding means A.

After two-folding or Z-folding by said folding means, the sheet P is guided through the discharge path 18 and the discharge rollers 20 and discharged from the sheet exit 5.

The sheet P discharged from said exit 5 of the folder unit 400 is guided into the sheet entrance 6 of the finisher unit 500 by the rollers 25 and 26. If a stacker mode is instructed to the finisher unit 500, the sheet P is guided to the stacker path 29 by the entrance deflector 27, pushing up the polyester strip 31, and is pinched between the roller 25 and the transport roller 32 and transported to the transport rollers 35. Then the sheet P is transported to the discharge rollers 37 while being pinched by the transport rollers 35, and the passing of the sheet P is detected by the sensor 36. The detection signal of said sensor 36 is transmitted to a control unit 800 (see FIG. 3) whereby the number of the sheets P is counted. Then the sheet P is ejected onto the stacker **11*a* by the discharge rollers 37**.

E. Control unit (800)

FIG. 3 shows an example of circuit structure of the control unit 800 of the embodiment shown.

Figure 8:
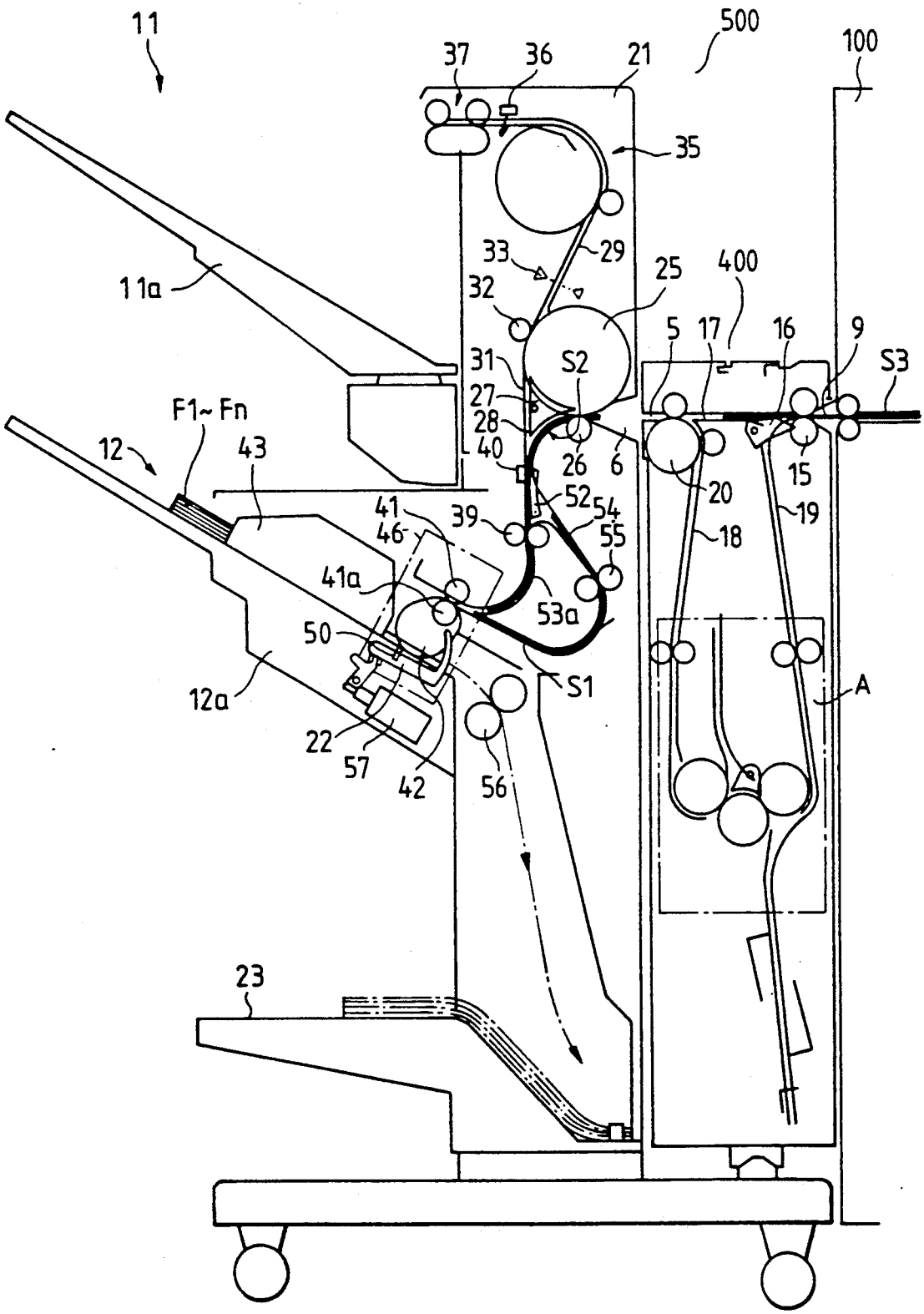

In FIG. 3, there are provided a central processing unit (CPU) 801 for sequence control of the present invention; a read-only memory (ROM) 803 storing, in advance, a control sequence shown in FIG. 8 and ensuing drawings, according to which the CPU 801 controls various components connected through a bus; and a random access memory (RAM) constituting a main memory used for input data storage and as a work memory area.

There are also provided interfaces (I/O) 807 and 813 for sending control signals of the CPU 801 to the main motor 133 and other loads; interfaces 809 and 815 for sending input signals for example from an image front-end sensor 121 to the CPU 801; and an interface 811 for input/output control of keys 600 and displays 700.

In the following there will be explained the function of the present embodiment.

Figure 4:
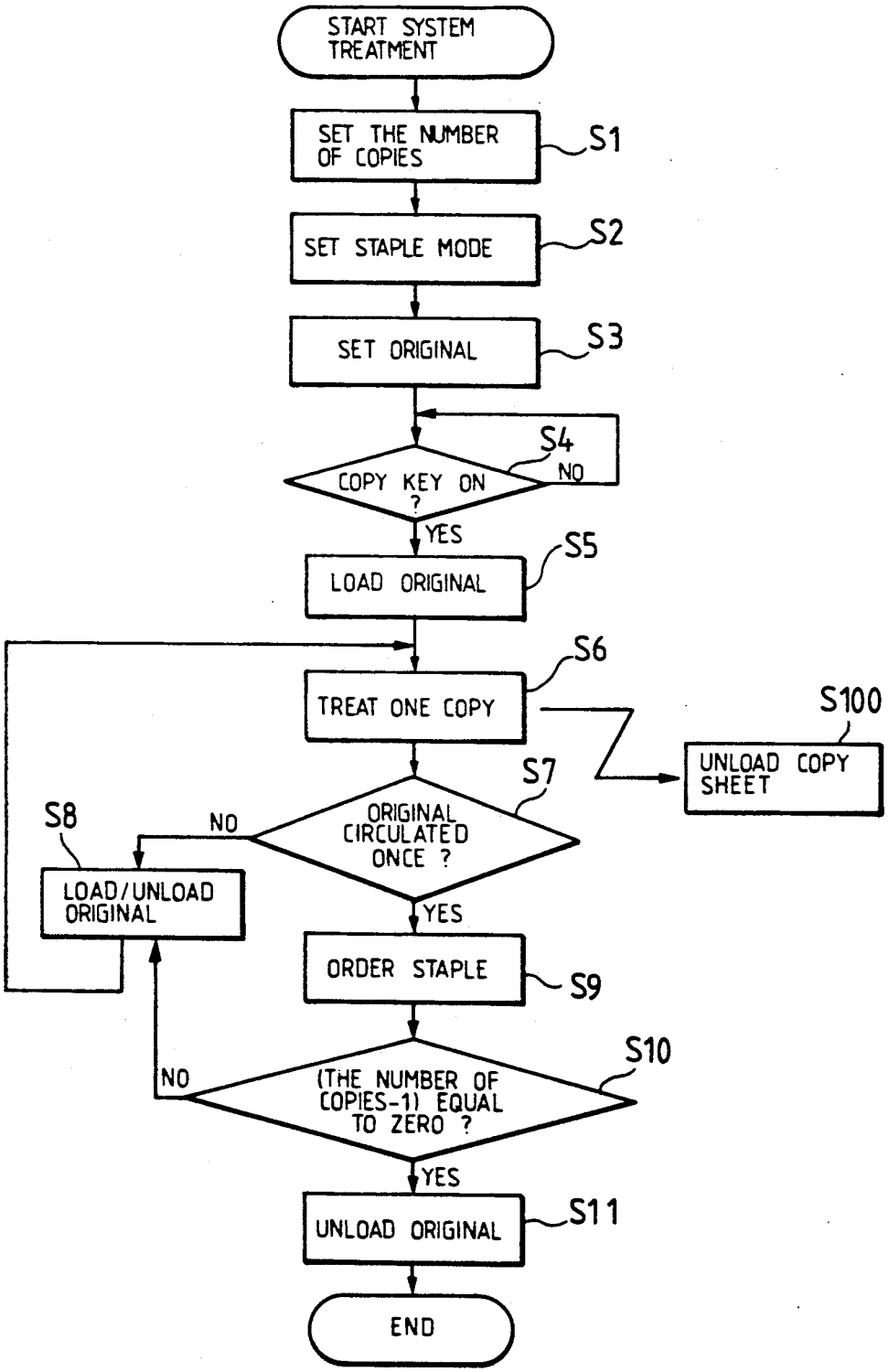
FIGS. 4, 5 and 6 are flow charts showing the control sequence.

A flow chart shown in FIG. 4 shows the control sequence of a system of the present invention in which the RDF 300, image forming apparatus (copying unit) 100, and sheet post-processing unit (finisher) 500 are combined At first a step S1 set the number of copies by copy number keys in the key group 600 of the copying unit, and a step S2 selects the stapling mode. A step S3 sets the original documents on the tray of the RED, and a step S4 starts the process in response to the actuation of a copy start key.

A step S5 causes the RDF to feed an original document to the original support glass 101 of the copying unit.

A step S6 causes a copying operation in the copying unit, and the sheet after copying is discharged to the finisher. In response the finisher unit effects a finishing sequence (S100) to be explained later. After the copying operation, a step S7 checks, by the sensor 307, if the original documents have completed a cycle. A step 8 effect discharge of the original document and feeding of a new original document and the step S6 effects the copying operation and the discharge of copy sheet until said cycle is completed. When said cycle is completed, the sequence proceeds from the step S7 to a step S9 for giving a stapling instruction to the finisher unit. Then a step S10 checks whether the preset number of copies have been made, and, if not, the sequence returns to the step S8. Thus the feeding and discharge of the original document, copying operation and stapling instruction are repeated until the preset number of copies are obtained. Finally a step S11 discharges the original document and terminates all the sequence.

Figure 6:
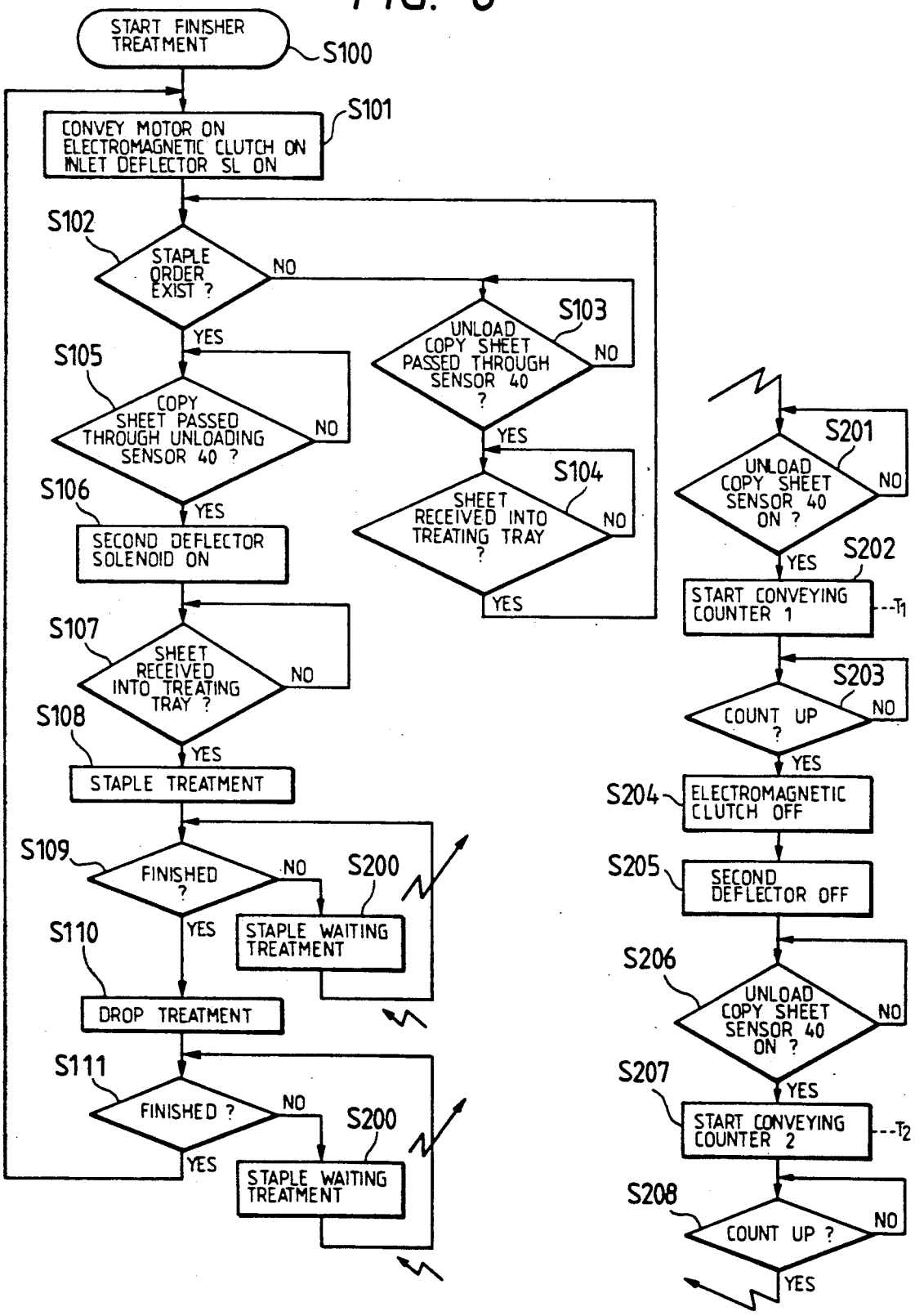
Figure 9:
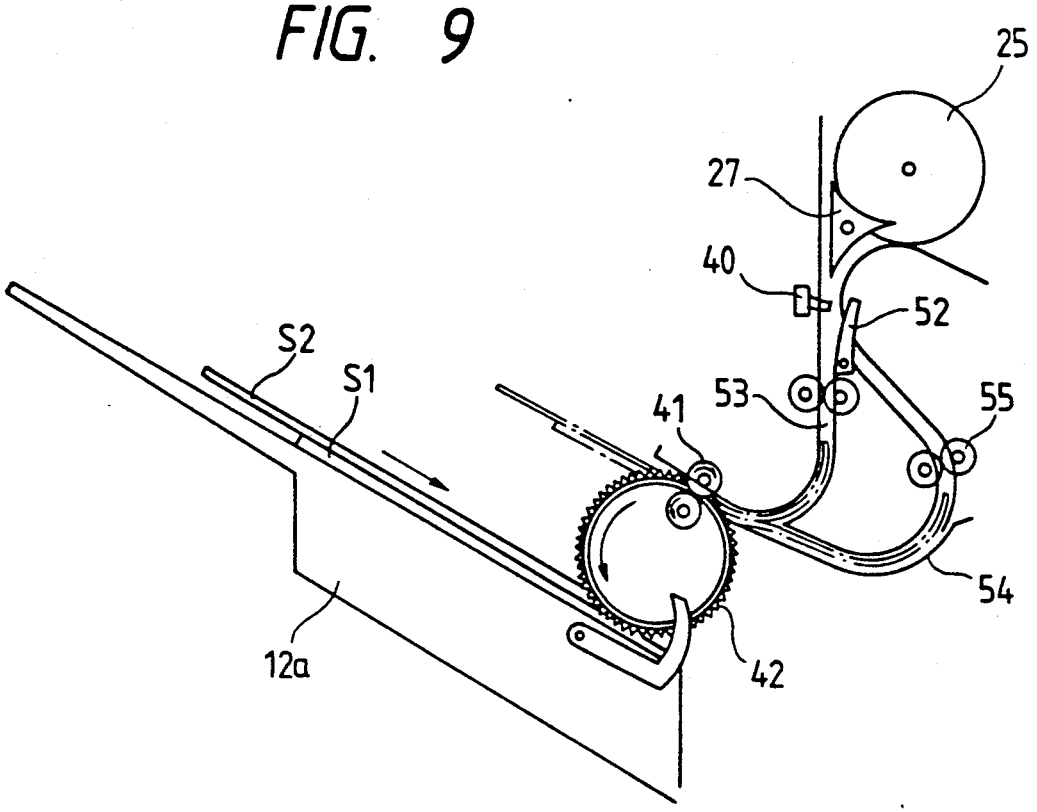
Figure 10:
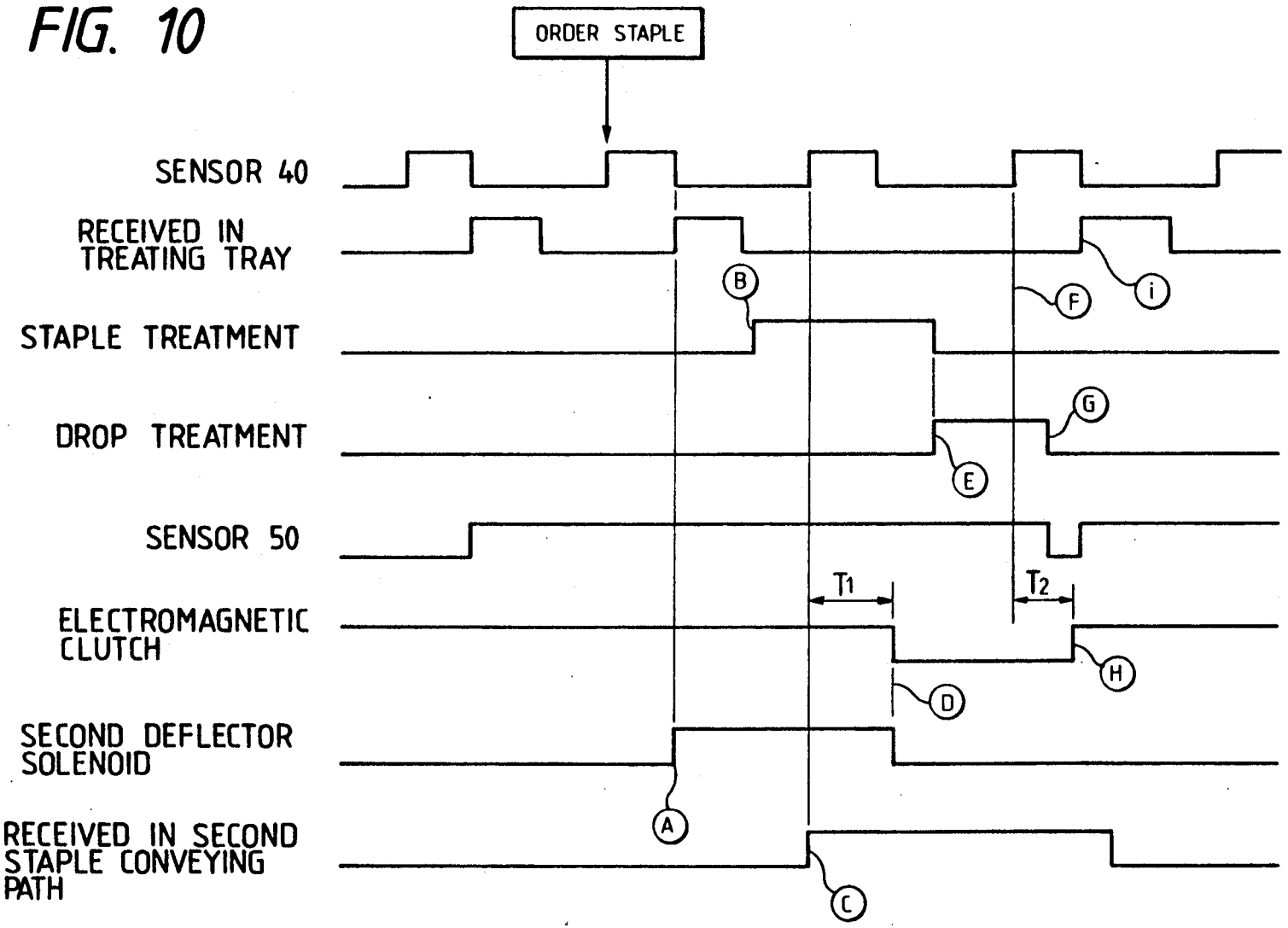
FIG. 10 is a timing chart showing the function of sheet transportation.

In the following there will be explained the sequence of the finisher unit, executed in parallel manner with the flow chart of FIG. 4, while making reference to a flow chart shown in FIG. 6, explanatory views shown in FIGS. 7 to 9 and a timing chart shown in FIG. 10.

A step 101 turns on the transport motor, electromagnetic clutch and entrance deflector solenoid 27, and, when the stapling mode is selected, a step S102 checks whether a stapling instruction has been given. If not, the sequence proceeds to a step S103.

In a step S103, the sheet $F_1$ discharged from the copying unit is introduced by the rollers 25 and 26 through the sheet entrance 6 of the finisher unit, and is guided into the stapling path 53 by the entrance deflector 27. Then the sheet $F_1$ is guided by the second deflector 52 into the first stapling path **52*a*, and, being pinched by the transport rollers 39, transported to the discharge rollers 41. Then the sheet $F_1$ is detected by the sensor 40 in a step S104, and discharged onto the processing tray 12*a* by the discharge rollers 41 (S104). Then it is registered in the transversal direction by pushing toward the positioning plate 43 by a pushing plate (not shown) The sheet $F_1$ is then registered in the advancing direction by pushing against the stopper 22 by the belt 42**.

Figure 7:
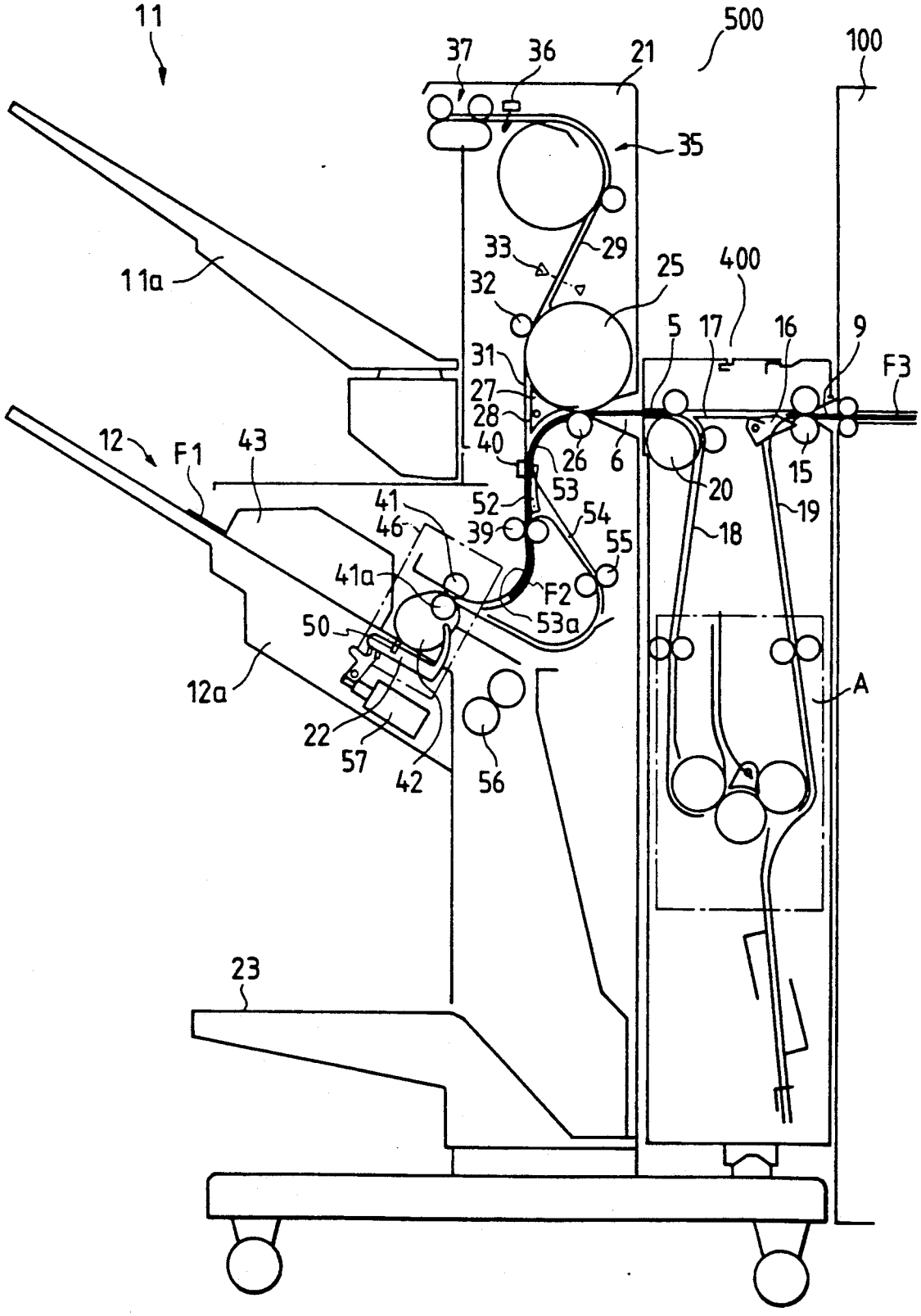
FIGS. 7, 8 and 9 are lateral cross-sectional views showing the function of the present invention.

Said steps S103 and S104 are repeated for each discharged sheet, so that, as shown in FIG. 7, the sheets $F_2$-$F_{n-1}$ are stacked in succession on the processing tray **12*a*. Then, when the stapling instruction is given from the copying unit in the step S102 (see FIG. 4; S9), namely when the sheet $F_n$ is discharged after a cycle of the original documents on the RDF, the sequence proceeds to a step S105 for detecting the passing of the sheet $F_n$ by the sensor 40. Then a step S106 energizes the second deflector solenoid 52*a* (see point A in FIG. 10) to shift the second deflector for the next sheet discharge. A step S107 effects lateral pushing after the sheet storage in the processing tray 12, and a step S108 effects stapling instructed by the copying unit (see point B in FIG. 10). During the stapling of the corner of the sheets $F_1$-$F_n$ by the stapler 46, a step S109 executes a staple waiting sequence S200** in parallel manner.

After a cycle of the original documents, a sheet S1 on which the image of the first original document is copied again is introduced, as shown in FIG. 8, into the sheet entrance 6 of the finisher unit by the rollers 25 and 26. It is then deflected by the entrance deflector 27 toward the stapler unit, then forwarded to the second stapling path 54 by the second deflector 52 and is pinched by the paired transport rollers 55 (see point C in FIG. 10). When a step S201 detects the front end or rear end of the sheet S1 by the sensor 40, a step S202 starts a transport counter 1. When the count of said transport counter 1 reaches a predetermined value (see step S203), namely when the front end of the sheet S1 reaches a predetermined position at the upstream side of the paired discharge rollers 41, a step S204 turns off the electromagnetic clutch **55*a* of the driving system, thereby terminating the rotation of the paired transport rollers 55, so that the sheet S1 remains in the second stapling path 54 (see point D in FIG. 10). Then a step S205 deactivates the second deflector solenoid to retract the second deflector from the first stapling path 53**.

At this moment the stapling operation on the processing tray 12 is just going to finish (see point E in FIG. 10), and the sequence proceeds to a dropping operation in a succeeding step S110.

In said dropping operation, the solenoid 57 is energized to retract the stopper 22 from the upper face of the processing tray **12*a*, whereby the bundle of the sheets $F_1$-$F_n$ is transported therefrom at a high speed by paired bundle transport rollers 56 and, with a speed reduction immediately before the ejection of bundle from said tray, dropped onto the storage tray 23. After the sensor 50 confirms the absence of the bundle of sheets $F_1$-$F_n$ on the processing tray 12*a*, the solenoid 57 is deactivated whereby the stopper 22 emerges on the processing tray 12*a***.

During said dropping operation, a step S111 executes the staple waiting step S200 in parallel manner, and a step S206 awaits the discharge of a next sheet S2 from the copying unit. Said next sheet S2 is transported by the rollers 25 and 26, guided into the first stapling path **53*a* by the second deflector 52 and forwarded to the paired transport rollers 39. After the detection of the front end of the sheet S2 by the sensor 40, a step S207 starts a transport counter 2 (see point F in FIG. 10), and a step S208 increases the count when the front end of the sheet S2 is pinched between the discharge rollers 41. At the same time the transport rollers 55 are activated by a electromagnetic clutch (not shown), whereby the sheet S1 supported by said rollers 55 as shown in FIG. 8 is transported to the discharge rollers 41** (see point H in FIG. 10). Consequently the sheet S2 and the sheet S1 superposed thereunder are pinched and transported by the discharge rollers 41, and are simultaneously discharged onto the processing tray 12a. At this moment the dropping operation of the processing tray 12a has been completed, so that said tray is empty (see point G in FIG. 10). The superposed sheets S2 and S1 land on the processing tray 12a, with the front end of the sheet S2 protruding from that of the sheet S1 (see point i in FIG. 10). Thus the rear end of the sheets S1 contacts the belt 42 earlier than that of the sheet S2, so that the sheet S1 is pulled back toward the stopper 22, and then the sheet S2 slides on the sheet S1 by the belt 42 and is registered with the sheet S1 against tee stopper 22 (cf. FIG. 9).

Subsequently two sheets are simultaneously registered in the transversal direction by a pushing member (not shown).

The succeeding sheet S3 and ensuing sheets are ejected, after ordinary copying operation, in succession to the processing tray 12a through the first stapling path 53a.

In the present embodiment, after the stapling instruction in the step S9 shown in FIG. 4, the steps S10, S8 and S6 can be executed without any waste in time, and the stapling operation can be conducted during normal copying operation with recirculation of the original documents for making a copy from each original document.

Figure 5:
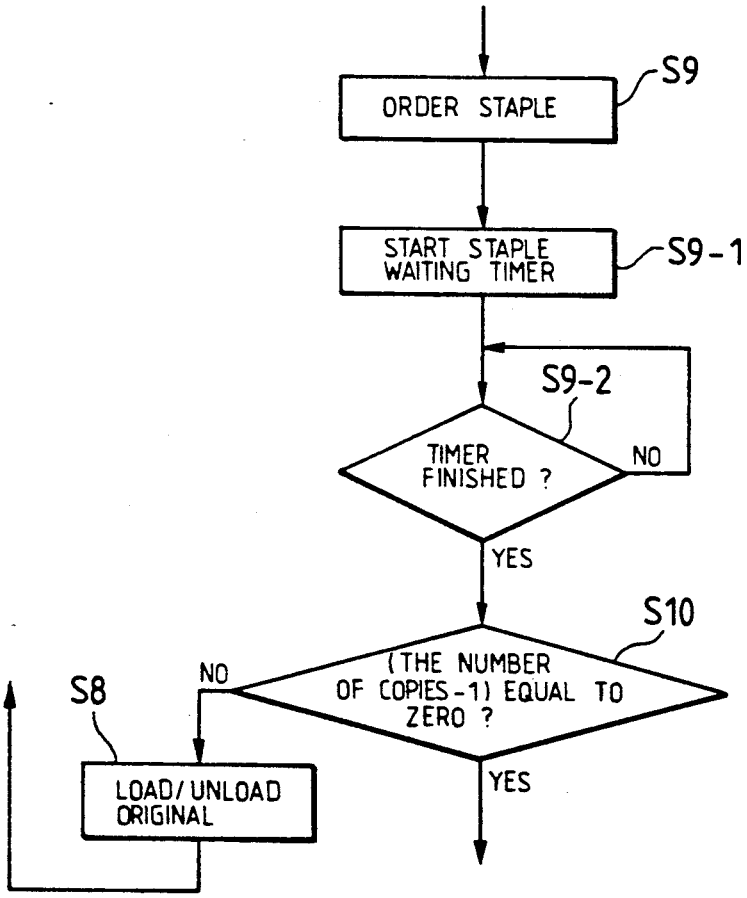

More specifically, during the stapling operation, in which the processing tray 12a is occupied, the next sheet is retained in the second stapling path 54, and it has become unnecessary to delay the next copying operation for example by a conventional sequence as shown in FIG. 5.

FIG. 5 shows a flow chart for delaying the succeeding copying operation during the stapling operation, in which a step S9-1 starts a staple waiting time for measuring a time corresponding to the period of processing. A step S9-2 awaits the expiration of said period, and the step S10 for checking the number of copies and the step S8 for discharge and feeding of original documents are conducted only after the expiration of said period.

Other embodiments

In the foregoing embodiment a second stapling path is provided in addition to the ordinary stapling path, and the sheet is retained in said second stapling path by stopping the rotation of the transport rollers 55 by an electromagnetic clutch. However, as another embodiment, it is also possible to delay the sheet discharge and to discharge the sheet in superposed state with the next sheet, by elongating the second stapling path, or controlling the speed of the transport rollers in said second stapling path for each sheet size. Variation of said speed can be dispensed with if the sheet size is limited. In this manner it is rendered possible to dispense with intermittently working means such as clutch.

Figure 11:
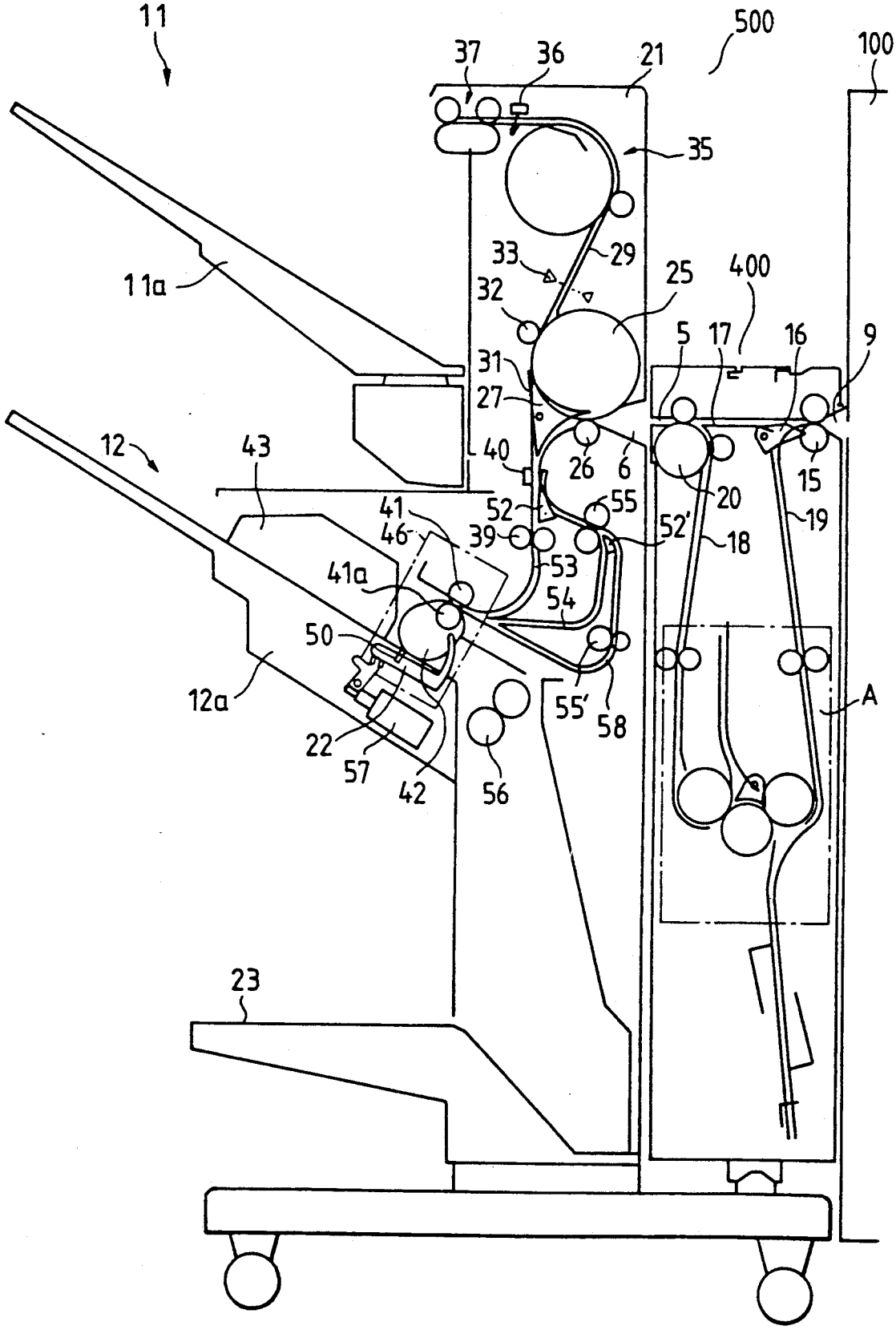

If the post-processing requires a longer time, it may become necessary to retain three sheets and discharge said sheets at the same time, in order not to interrupt the operation of the image forming apparatus. As still another embodiment, it is also possible to add another transport path 58 as shown in FIG. 11.

Figure 12:
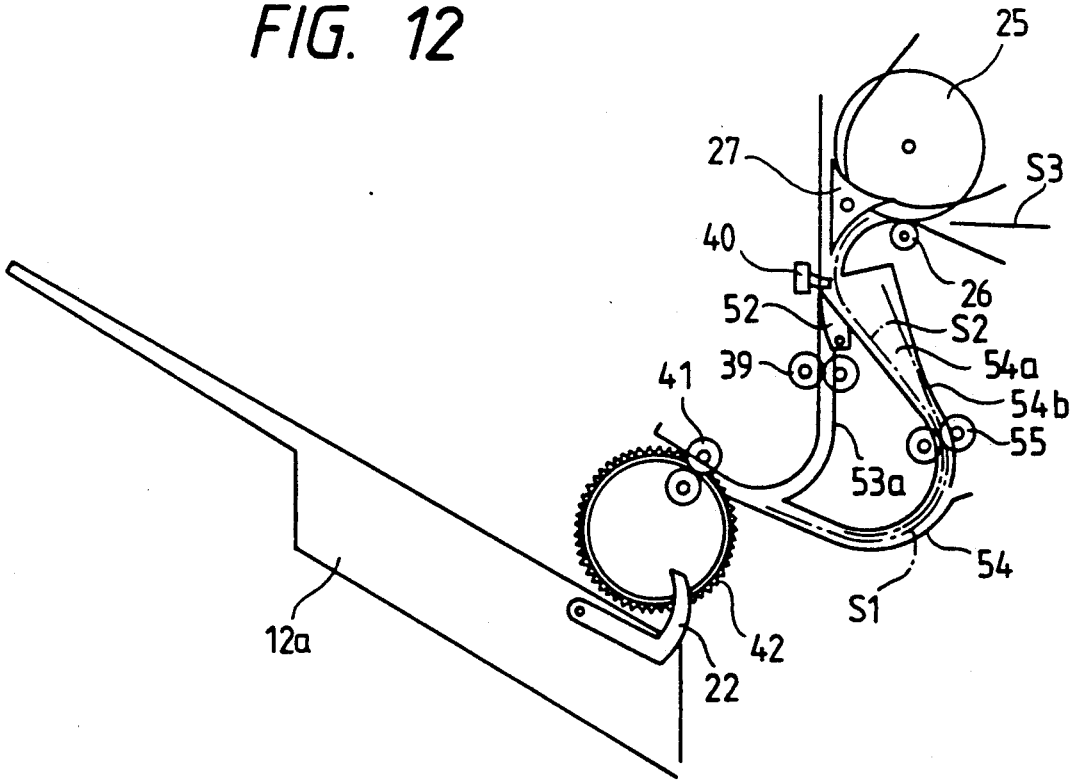
FIGS. 11, 12 and 13 are lateral cross-sectional views showing other embodiments of the sheet post-processing apparatus of the present invention.

As still another embodiment, it is also possible, as shown in FIG. 12, to retain plural sheets in the second stapling path 54.

In this case, the first sheet S1 is retained in the second stapling path 54, and the next sheet S2 is also guided to the second stapling path 54 by the second deflector 52. The second stapling path 54 is provided with a space 54a at the upstream side, and the rear end of the retained sheet S1 is positioned close to a guide plate 55b defining the space 54a, so that the sheet S2 is superposed on the sheet S1 when discharged onto the processing tray 12a. The transport rollers 55 are driven only at a side contacting the sheet S2. Whereby the sheet S2 alone is transported, sliding on the stopped sheet S1. The sheet S2 is advanced until the front end thereof becomes positioned at the downstream side of the front end of the sheet S1. The next sheet S3 is guided to the first stapling path 53a by the shifting of the second deflector 52.

Figure 13:
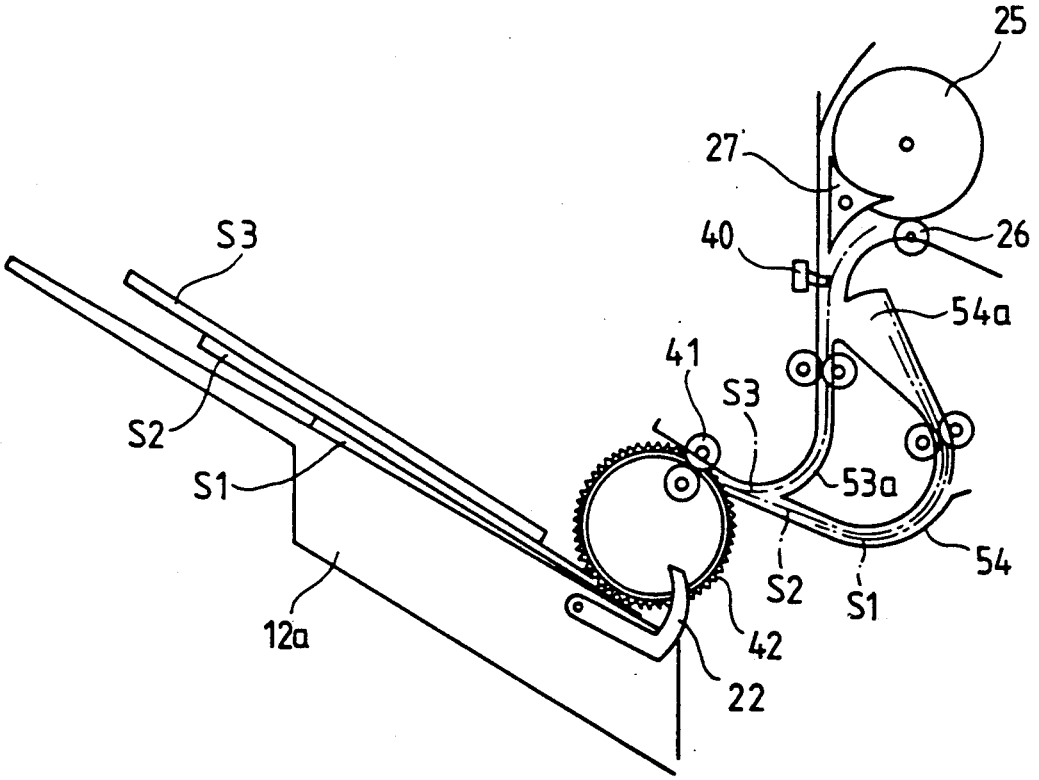

Then the transport rollers 55 are activated at such a timing that the sheets S1, S2 and S3 are discharged in the superposed state. In this case the transport rollers 39 and 55 are so controlled that the front end of the sheet S3 is positioned at the downstream side of the front end of the sheet S2, whereby the sheets S1, S2 and S3 are stacked in a solid-lined state in FIG. 13, thus ensuring secure registration.

In the foregoing embodiments, a stapling unit is employed as the processing unit, and the present invention is not limited to such case. The present invention is applicable if the sheet post-processing requires a time longer than the interval of sheet discharge for example of an image forming apparatus. For example, in a processing apparatus for grouping the sheets discharged from the image forming apparatus by moving trays in horizontal direction after discharge of each group of sheets, the present invention can be applied to prevent interruption of the copying operation, by retaining the sheets of the next group, discharged from the image forming apparatus during the movement of the tray, in the second transport path.

The present invention is applicable also in an image forming apparatus in which the sheets bearing image on a face thereof are stored in an intermediate tray and sent again to the image forming means for the purpose of forming images on both faces or forming multiple images on a face. In such case, the sheets are subjected to processings such as decurling, registration, skew, feed treatment etc. on the intermediate tray. It is therefore possible to avoid interruption of the image formation during such processing, by branching the sheet transport path (see 226 in FIG. 1) to the processing means of the intermediate tray into first and second paths, then retaining a sheet in the second path during the processing of preceding sheets in the intermediate tray, and guiding a next sheet to the first path and sending two sheets almost at the same time to the intermediate tray.

In the embodiment shown in FIG. 1, the present invention is applied to an image forming apparatus for copying the image of sheet originals onto sheets. However, the image forming apparatus shown in FIG. 1 may be replaced by an image forming apparatus for image recording on a sheet corresponding to electrical information, such as a laser beam printer, a wire dot printer or an ink jet printer. In a system for recording a group of information on groups of plural sheets each, and stapling each group of sheets, the present invention allows image formation of next group of information while a group of sheet is stapled.

What is claimed is:

1. A sheet handling apparatus comprising:

sheet processing means for processing sheets;

a first sheet transport path for transporting sheets to said sheet processing means;

a second sheet transport path, separate from said first sheet transport path, for transporting sheets to said sheet processing means;

transport direction switch means for guiding the sheet either to said first sheet transport path or to said second sheet transport path; and control means for controlling said transport direction switch means so that a first sheet is guided to said second path while a second sheet is guided to said first path after an operating demand to said sheet processing means has been outputted;

wherein the first and second sheets are sent to said sheet processing means in a mutually superposed state.

2. An apparatus according to claim 1, wherein said sheet processing means comprises a stapler for stapling the sheets.

3. An apparatus according to claim 1, wherein said sheet processing means comprises trays to be moved in horizontal direction at each discharge of a group of sheets for grouping the sheets.

4. An apparatus according to claim 1, wherein said first sheet and said second sheet are fed to said sheet processing means in a state wherein they are stacked or superposed but offset from each other in a feeding direction.

5. An apparatus according to claim 1, wherein said first sheet transport path and second sheet transport path are join at the downstream side in the transport direction.

6. An image forming apparatus comprising:

image forming means for image formation on a sheet;

sheet processing means for processing sheets on which images are formed by said image forming means;

a first sheet transport path for transporting the sheet, on which an image is formed by said image forming means, to said sheet processing means;

a second sheet transport path branched from said first sheet transport path and join thereto at the downstream side in the transport direction;

transport direction switch means for guiding the sheet, sent from the image forming means, either to said first sheet transport path or to said second sheet transport path; and control means for controlling said transport direction switch means so that a first sheet fed from said image forming means is guided to said second path while a second sheet fed from said image forming means is guided to said first path after an operating demand to said sheet processing means has been outputted;

wherein the second and first sheets are sent to said sheet processing means in a mutually superposed state.

7. An apparatus according to claim 6, wherein said image forming means is adapted to form the image of a sheet original onto a sheet.

8. An apparatus according to claim 6, wherein said image forming means is adapted to form the image of electrically transmitted information on a sheet.

9. An apparatus according to claim 6, wherein said sheet processing means comprises a stapler for stapling sheets.

10. An apparatus according to claim 6, wherein said sheet processing means comprises trays to be moved horizontally for each discharge of a group of sheets, for grouping said sheets.

11. An apparatus according to claim 6, wherein the first sheets and the second sheet are fed to said sheet processing means in a state wherein they are stacked but offset from each other in a feeding direction.

12. An apparatus according to claim 6, wherein said first sheet is temporarily stopped in the second sheet transport path.

13. An image forming apparatus comprising:

image forming means for forming images of a group of information on plural sheets;

stapling means for binding sheets of each information group, on which an image has been formed by said image forming means;

a first sheet transport path for transporting the sheet on which an image has been formed by said image forming means to said stapling means;

a second sheet transport path, separate from said first sheet transport path, for transporting the sheet on which an image has been formed by said image forming means to said stapling means;

transport direction switch means for guiding the sheet either to said first sheet transport path or to said second sheet transport path;

control means for controlling said transport direction switch means in such a manner that a first one in a group of sheets on which images of a group of information have been formed by said image forming means is guided to said second sheet transport path, and a next one is guided to said first sheet transport path; and the second and first sheets are sent to said sheet staple means in a mutually superposed state.

14. An image forming apparatus according to claim 13, wherein the first sheet and the second sheet are fed to said sheet processing means in a state wherein they are stacked but offset from each other in a feeding direction.

15. An apparatus according to claim 13, wherein said first sheet is stopped temporarily in said second sheet transport path.

16. A sheet handling apparatus comprising:

sheet processing means for processing sheets;

a first sheet path for guiding the sheets to said sheet processing means;

a second sheet path for guiding the sheets to said processing means;

switching means for guiding the sheets fed to either of said first sheet path or said second sheet path;

controlling means for controlling said switching means so that a sheet is guided to said first sheet path while another sheet is guided to said second sheet path; and the sheets guided by the first and second sheet path being fed to said sheet processing means in a stacked state.

17. A sheet handling apparatus according to claim 16, wherein said sheet processing means includes a stapler for binding the sheets.

18. A sheet handling apparatus according to claim 16, wherein said sheet processing means has a tray movable substantially in a horizontal direction after completion of feeding of the sheets of each group to said sheet processing means for classifying the sheets of each group.

19. A sheet handling apparatus according to claim 16, wherein said first sheet path and said second sheet path are joined upstream of said sheet processing means.

20. A sheet handling apparatus according to claim 16, wherein the sheets pass through said second sheet path one by one.

21. A sheet handling apparatus according to claim 20, further having a conveying means for conveying a sheet to be passed through said first sheet path.

22. A sheet handling apparatus according to claim 21, wherein said conveying means stops an operation thereof for a time to stay a sheet in said first sheet path for a time.

23. A sheet handling apparatus comprising:

stacking means for stacking sheets;

processing means for processing the sheets stacked in said stacking means;

a first path for guiding the sheets to said stacking means;

a waiting path for guiding the sheets to said stacking means one by one after a delay time;

switching means for guiding the sheets to either of said first path or said waiting path; and control means for controlling the switching of said switching means after an operating demand to said processing means has been outputted.

24. A sheet handling apparatus according to claim 23, wherein said control means controls said switching means to switch from said first path to said waiting path after the sheet feeding of one group to said stacking means has been finished.

25. A sheet handling apparatus according to claim 23, wherein said sheet processing means includes a stapler for binding the sheets.

26. A sheet handling apparatus according to claim 23, wherein said sheet processing means has a tray movable substantially in a horizontal direction after completion of feeding of sheets of each group to said sheet processing means for classifying the sheets of each group.

27. A sheet handling apparatus according to claim 23, wherein said first path and said waiting path are joined upstream of said stacking means.

28. A sheet handling apparatus according to claim 27, wherein said control means controls the switching of said switching means so that the second sheet succeeding to the first sheet is guided to said first path after said switch means is switched to the waiting path to guide the first sheet thereto.

29. A sheet handling apparatus according to claim 28, wherein the first sheet and the second sheet are fed to said stacking means substantially simultaneously.

30. A sheet handling apparatus according to claim 29, further having conveying means for conveying the first sheet to be passed through said waiting path.

31. A sheet handling apparatus according to claim 30, wherein said control means controls said conveying means so that the first sheet and the second sheet are fed to said stacking means substantially simultaneously.

32. A sheet handling apparatus according to claim 31, wherein said conveying means stops an operation thereof for a time to stay the first sheet in wait waiting path for a time.

33. A sheet handling apparatus according to claim 29, wherein said control means controls said switching means so that said first path is switched to said waiting path after a signal causing a start of processing is outputted to said sheet processing means.

34. A sheet handling apparatus comprising:

stacking means for stacking sheets;

processing means for processing the sheets stacked in said stacking means;

a second path for guiding the sheets to said stacking means;

switching means for guiding the sheets said to either of said first path or said second path;

detecting means for detecting passage of the sheets at said first path and outputting a detecting signal;

conveying means for conveying the sheets to be passed through said second path;

control means for controlling the switching of said switching means so that the first sheet is guided to said second path while the second sheet succeeding to the first sheet is guided to said first path, and controlling said conveying means so that the first sheet is stopped in said second path while the second sheet is conveyed after the detection of the first sheet by said detecting means.

35. A sheet handling apparatus according to claim 34, wherein said processing means includes a stapler for binding the sheets.

36. A sheet handling apparatus according to claim 34, wherein said processing means moves said stacking means for classification.

37. A sheet handling apparatus according to claim 34, wherein said first path and said second path are joined upstream of said stacking means.

38. A sheet handling apparatus according to claim 34, wherein said control means carrys out the controlling after a signal for causing said processing means to start the processing is outputted thereto.

39. A sheet handling apparatus according to claim 34, wherein said conveying means is controlled by said control means so that the first sheet is stopped after being conveyed for a predetermined distance through said second path, and starts conveying of the first sheet after a predetermined time lapse due to the detection of an end of the second sheet by said detecting means.

40. A sheet handling apparatus according to claim 34, wherein the first sheet and the second sheet are fed to said stacking means substantially simultaneously.

41. A sheet handling apparatus according to claim 40, wherein the first sheet and the second sheet are fed to said stacking means in a stacked state.

42. A sheet handling apparatus according to claim 41, wherein the first sheet and the second sheet are fed to said stacking means in a state wherein they are stacked but offset from each other in a conveying direction.

43. An image forming apparatus comprising:

original supplying means for feeding a set of originals stacked in a predetermined position to an original reading position one by one, and returning the original from the original reading position to the predetermined position;

a cycle sensor for detecting that all of one set of originals are fed to said original reading position;

an image forming means for successively forming images of the originals fed to the original reading position on sheets;

stacking means for stacking the sheets;

a first path for guiding the sheets to said stacking means;

a second path for guiding the sheets to said stacking means;

switching means for guiding the sheets on which the image is formed by said image forming means to either of said first path or second path;

processing means for processing the sheets stacked on said stacking means; and control means for controlling switching of said switching means based on the detection by said cycle sensor.

44. An image forming apparatus according to claim 43, wherein said processing means includes a stapler for binding the sheets.

45. An image forming apparatus according to claim 43, wherein said processing means includes a means for moving said stacking means substantially horizontally for classifying a group of the sheets on which images of a set of originals is formed from other group of the sheets.

46. An image forming apparatus according to claim 43, wherein said first path and said second path are joined upstream of said stacking means.

47. An image forming apparatus according to claim 43, wherein said control means controls said switching means based on the detection by said cycle sensor so that the sheets are guided to said second path.

48. An image forming apparatus according to claim 47, wherein said control means controls said switching means so that the first sheet is guided to said second path based on the detection by said cycle sensor and then the second sheet fed succeeding to the first sheet is guided to said first path.

49. An image forming apparatus according to claim 48, wherein the first sheet and the second sheet are fed to said stacking means substantially simultaneously.

50. An image forming apparatus according to claim 48, further including conveying means for conveying the first sheet through said second path.

51. An image forming apparatus according to claim 50, wherein said control means stops the operation of said conveying means for a time so that the first sheet and the second sheet are fed to said stacking means substantially simultaneously.

52. An image forming apparatus, comprising:

image forming means for forming an image on a sheet;

sheet processing means for processing the sheet;

a first sheet path for guiding one sheet on which the image is formed to said sheet processing means;

a second sheet path for guiding other sheets on which the image is formed to said sheet processing means;

switching means for guiding the sheet fed to either of said first sheet path or second sheet path; and controlling means or controlling said switching means so that the one sheet is guided to said first sheet path while the other sheet is guided to said second sheet path;

wherein each sheet guided by said first and second sheet path is fed to said sheet processing means in a stacked state.

53. An image forming apparatus according to claim 52, wherein said sheet processing means includes a stapler.

54. An image forming apparatus according to claim 52, wherein said sheet processing means has a tray movable substantially in a horizontal direction after completion of feeding of the sheets of each group to said sheet processing means for classifying the sheets of each group.

55. An image forming apparatus according to claim 52, wherein said first sheet path and second sheet path are joined upstream of said sheet processing means.

56. An image forming apparatus according to claim 52, wherein the sheets pass through said second sheet path one by one.

57. An image forming apparatus according to claim 56, further having a conveying means for conveying one sheet to be passed through said first sheet path.

58. An image forming apparatus according to claim 57, wherein said conveying means delays an operation thereof to hold one sheet in said first sheet path for a time.

* * * * *

UNITED STATES PATENT AND TRADEMARK OFFICE

CERTIFICATE OF CORRECTION

PATENT NO. : 5,112,034

DATED : May 12, 1992

INVENTOR(S) : UTO, et al.

It is certified that error appears in the above-identified patent and that said Letters Patent is hereby corrected as shown below:

ON THE TITLE PAGE

[57] ABSTRACT
Line 2, "and a" should be deleted.

COLUMN 1
Line 32, "sheet," should read --sheets,--.

COLUMN 2
Line 68, "500" should read --finisher unit 500--.

COLUMN 3
Line 48, "photo-sensitive" should read --photosensitive--.

COLUMN 5
Line 19, "entrance" should read --entrance 9--; and
Line 27, "entrance 9 At" should read --entrance 9. At--.

COLUMN 6
Line 1, "52driven" should read --52 driven--.

UNITED STATES PATENT AND TRADEMARK OFFICE

CERTIFICATE OF CORRECTION

PATENT NO. : 5,112,034

DATED : May 12, 1992

INVENTOR(S) : UTO, et al.

It is certified that error appears in the above-identified patent and that said Letters Patent is hereby corrected as shown below:

COLUMN 7

Line 31, "step 8" should read --step S8--;
Line 50, "step 101" should read --step S101--; and
Line 66, "shown) The" should read --shown). The--.

COLUMN 9

Line 14, "tee" should read --the--.

COLUMN 10

Line 8, "sheet S2. Whereby" should read --sheet S2, whereby--.

COLUMN 11

Line 31, "join" should read --joined--; and
Line 42, "join" should read --joined--.

COLUMN 12

Line 4, "sheets" should read --sheet--.

UNITED STATES PATENT AND TRADEMARK OFFICE

CERTIFICATE OF CORRECTION

PATENT NO. : 5,112,034

DATED : May 12, 1992

INVENTOR(S) : UTO, et al.

It is certified that error appears in the above-identified patent and that said Letters Patent is hereby corrected as shown below:

COLUMN 13

Line 12, "stay" should read --hold--;

Line 21, "one by one" should be deleted;

Line 61, "stay" should read --hold-- and "wait" should read --said--; and

Line 63, "claim 29," should read --claim 23,--.

COLUMN 14

Line 3, "stacking means;" should read --stacking means; a first path for guiding the sheets to said stacking means;--; and Line 6, "said" should be deleted.

COLUMN 16

Line 10, "or" should read --for--.

Signed and Sealed this

Twenty-first Day of September, 1993

Bruce Lehman

*Attest:*

BRUCE LEHMAN

*Attesting Officer*

*Commissioner of Patents and Trademarks*